US007500740B2

(12) United States Patent
Inoue

(10) Patent No.: US 7,500,740 B2
(45) Date of Patent: Mar. 10, 2009

(54) INK TANK

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 409 days.

(21) Appl. No.: 11/391,243

(22) Filed: Mar. 29, 2006

(65) Prior Publication Data

US 2006/0221155 A1 Oct. 5, 2006

(30) Foreign Application Priority Data

Mar. 30, 2005 (JP) ..... 2005-099473

(51) Int. Cl.
*B41J 2/175* (2006.01)

(52) U.S. Cl. ..... 347/86

(58) Field of Classification Search ..... 347/7, 347/19, 85, 86, 87
See application file for complete search history.

(56) References Cited

U.S. PATENT DOCUMENTS 4,368,478 A * 1/1983 Koto ..... 347/86
5,652,610 A * 7/1997 Kawai et al. ..... 347/87
5,997,121 A * 12/1999 Altfather et al. ..... 347/7
6,145,972 A * 11/2000 Udagawa et al. ..... 347/86
6,206,514 B1 * 3/2001 Tajima et al. ..... 347/86
6,618,776 B1 * 9/2003 Zimmermann et al. ..... 710/117
6,679,574 B2 * 1/2004 Sato ..... 347/7
6,848,776 B2 * 2/2005 Nishioka et al. ..... 347/86

FOREIGN PATENT DOCUMENTS

JP 7-117238 A 5/1995

* cited by examiner

*Primary Examiner*—Anh T. N. Vo
(74) *Attorney, Agent, or Firm*—Birch, Stewart, Kolasch & Birch, LLP

(57) ABSTRACT

An ink cartridge contains an ink absorbent in an ink chamber, to absorb and hold ink by a capillary force. The ink absorbent has a cutout in its lower portion, to form a compartment without the ink absorbent. An ink detection zone is defined in the compartment, for an ink run-out sensor to detect the ink in the ink chamber. As the ink is consumed and the liquid surface of the ink goes down, an interface between the ink absorbent and the compartment enhances the resistance to the ink flowing from the ink absorbent toward the ink detection zone, so the ink is hindered from flowing into the ink detection zone, and the ink run-out sensor exactly detects that the liquid surface of the ink goes below the ink detection zone.

12 Claims, 5 Drawing Sheets

INK TANK

FIELD OF THE INVENTION

The present invention relates to an ink tank containing ink to be supplied to an ink-jet type recording head.

BACKGROUND OF THE INVENTION

An ink-jet recording apparatus has been known, which has a recording head for discharging ink as droplets onto a recording paper to print an image. The ink-jet recording apparatus is provided with at least an ink tank containing ink, to supply the ink from the ink tank to the recording head. In a serial ink-jet recording apparatus, a recording head is mounted to a carriage that moves back and forth in a main scanning direction, a widthwise direction of a recording paper. Each time the carriage makes one lap, the recording head records a line of image, and the recording paper is fed in a sub scanning direction orthogonal to the main scanning direction by an amount corresponding to the image line. Thus, an image frame is recorded line after line.

Because the ink is a consumable material, the ink tank is often formed as a cartridge that is removably attached to the ink-jet recording apparatus, so as to make it easy to supplement the ink-jet recording apparatus with the ink. Such a cartridge type ink tank, hereinafter called the ink cartridge, is attached to the carriage in association with the recording head.

In order to notify the user of necessity to replace the ink cartridge, the ink-jet recording apparatus is provided with an ink sensor for detecting the residual amount of ink in the ink tank. For example, as disclosed in Japanese Laid-open Patent Application No. 7-117238, a photo sensor is used as the ink sensor, which consists of a light emitter emitting a light beam and a light receiver receiving a reflected light beam from the ink tank, to detect the residual amount of ink optically. The photo sensor is mounted to the carriage, with the light emitter and the light receiver placed in face to an ink detection zone that is located near a bottom of an ink chamber of the ink cartridge.

As the residual amount of ink in the ink chamber decreases, the liquid surface of the ink goes down toward the bottom of the ink chamber. Accordingly, when the liquid surface of the ink goes below the ink detection zone, the photo sensor detects that the ink does not exist in the ink detection zone, which is judged as an ink end of the ink cartridge.

However, as the ink cartridge moves back and forth together with the carriage, the ink waves in the ink chamber. Even while the liquid surface of the ink is lower than the detection zone when the ink cartridge stands still, the ink can flow into the ink detection zone, raising the level of the liquid surface of the ink up into the ink detection zone. Then, the ink sensor wrongly detects that the ink exits in the ink detection zone. The same detection error can occur in an ink cartridge that is unloaded before the ink is used up, and is reloaded, because such an ink cartridge can be shaken while it is carried about.

SUMMARY OF THE INVENTION

In view of the foregoing, a primary object of the present invention is to provide an ink tank that prevents the detection error of the ink sensor that detects the surface level of the ink in the ink tank.

To achieve the above object in an ink tank containing ink in an ink chamber, for supplying the ink to an ink-jet recording head, the present invention suggest providing an interface around an ink detection zone that is defined in the ink chamber, for an ink run-out sensor to detect as to whether the ink exits or not, wherein the interface enhances resistance to the ink flow in a direction toward the ink detection zone more than in a reversed direction when the ink is consumed so much that its liquid surface goes out of the ink detection zone.

According to a preferred embodiment, a first ink absorbent is placed in the ink chamber, the first ink absorbent having a capillary force to absorb and hold the ink in the first ink absorbent, and generate a negative pressure in the ink chamber, wherein the first ink absorbent is not located in a space including the ink detection zone, to provide the interface between the space and boundary surfaces of the first ink absorbent which border the space.

According to a more preferable embodiment, a second ink absorbent is placed in the space. The second ink absorbent is preferably spaced apart from the first ink absorbent.

The first and second ink absorbents may be made of the same material, or different materials from each other.

The second ink absorbent preferably has a weaker capillary force than the first ink absorbent.

According to another embodiment, the second ink absorbent has such contractibility that its volume decreases as the ink absorbed in the second ink absorbent decreases.

Because of the resistance to the ink flow in the direction toward the ink detection zone, the ink is hindered from flowing into the ink detection zone after the liquid surface of the ink goes out of the ink detection zone, even when the ink tank is shaken. The second ink absorbent suppresses waves of the ink in the space including the ink detection zone.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
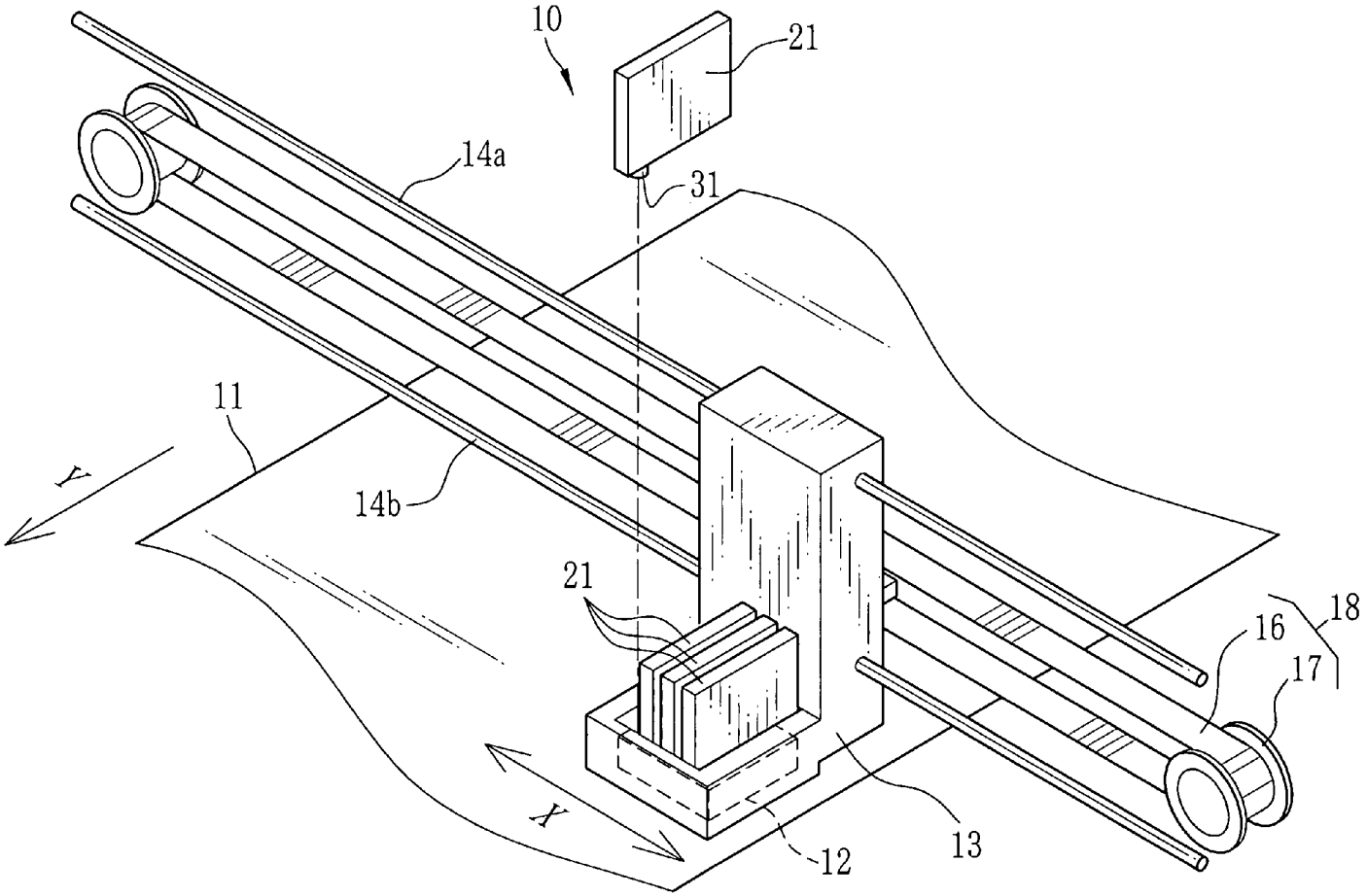
FIG. 1 is an explanatory diagram illustrating essential elements of an ink-jet recording apparatus according to an embodiment of the invention.

An ink-jet recording apparatus 10 shown in FIG. 1 is provided with a recording head 12 that discharges ink toward a recording paper 11 to print images thereon. The recording head 12 is provided with a plurality of not-shown nozzles for discharging the ink from individual outlets. The outlets of the nozzles are aligned in a plane to form a discharging surface, and the discharging surface is placed in face to a recording surface of the recording paper 11. The recording head 12 is mounted in a carriage 13 that is movable in a widthwise direction of the recording paper 11, that is, a main scanning direction X. The discharging surface is exposed through an opening formed through a bottom of the carriage 13. While reciprocating in the widthwise direction of the recording paper 11 together with the carriage 13, the recording head 12 records an image in a line sequential fashion. Each time the recording head 12 makes one lap to record a line of the image, the recording paper 11 is fed by not-shown conveyer rollers in a sub scanning direction Y, that is orthogonal to the main scanning direction X, by a length corresponding to a width of each image line as recorded by the recording head 12. Thus, the image is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 21, e.g. four cartridges containing inks of four different colors: yellow, magenta, cyan and black.

The carriage 13 is provided with not-shown slots, into which the ink cartridge 21 is plugged. In each slot, there is provided an ink supply needle 36, see FIG. 2, having a through-hole as a path for supplying the ink to the recording head 12. When the ink cartridge 21 is plugged in the slot, the ink supply needle 36 is stuck into an ink outlet 31 that is formed on a bottom of the ink cartridge 21, so the ink contained in the ink cartridge 21 is supplied through the ink outlet 31 to the recording head 12. In the recording head 12, oscillation plates are provided in one-to-one relationship with the nozzles. Each of the oscillation plates is driven individually by a piezoelectric element, to change the pressure. Thereby, the ink in the ink cartridge 21 is sucked into the nozzle, and is ejected from the outlet of the nozzle.

Figure 2:
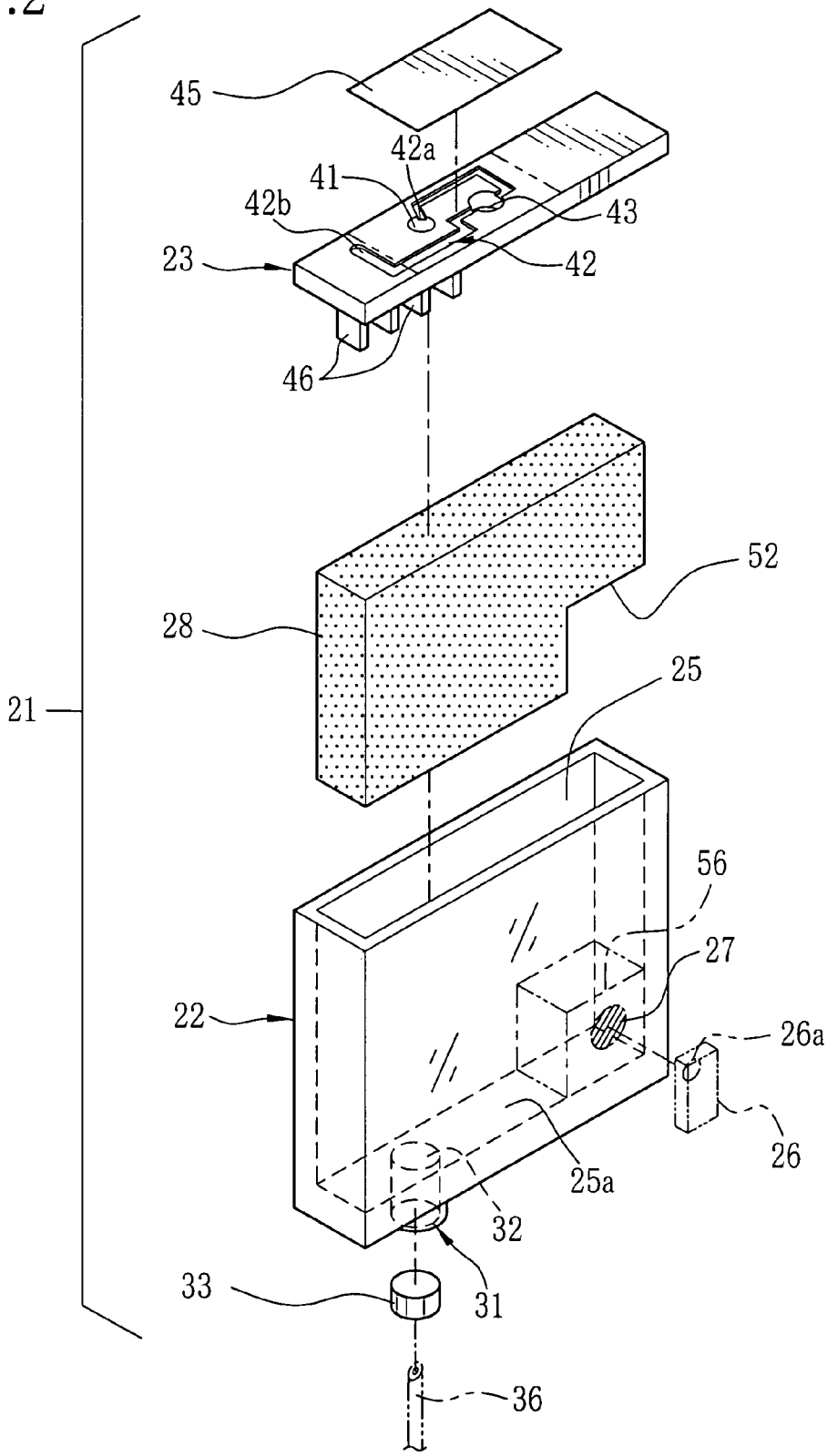
FIG. 2 is an exploded perspective view of an ink cartridge used in the ink-jet recording apparatus of FIG. 1.

As shown in FIG. 2, the ink cartridge 21 consists of a case body 22 and a lid 23 for closing an open top of the case body 22. The lid 23 is affixed to the case body 22, for example, by welding, after the case body 22 is filled with the ink. Thereby, the ink is prevented from leaking through the open top of the case body 22. The case body 22 is formed from a transparent plastic or the like, so the remaining amount of the ink in the ink cartridge 21 is visible from outside. The case body 22 is provided with an ink chamber 25.

The ink-jet recording apparatus 10 is provided with an ink run-out sensor 26, for the sake of notifying the use that the ink cartridge 21 has run out of the ink. In the illustrated embodiment, the ink run-out sensor 26 is a reflective photo sensor that has a detective section consisting of a light emitter and a light receiver. The light emitter emits a light beam toward an ink detection zone 27 of the ink cartridge 21, and the light receiver receives a reflected light beam from the ink detection zone 27.

Instead of the reflective photo sensor 26, a photo sensor like a photo interrupter is usable, wherein a light emitter and a light receiver are opposed to each other, so the light emitter emits a light beam toward the ink detection zone, and the light receiver receives the light beam as penetrating through the ink detection zone.

The ink run-out sensor 26 outputs a signal of a level corresponding to the amount of the reflected light, which varies depending upon whether there is the ink in the ink detection zone or not. So the ink-jet recording apparatus 10 determines based on the output level of the signal from the ink run-out sensor 26, as to whether the ink in the storage chamber 25 is used up or not. The ink run-out sensor 26 is mounted to on a carriage 13 in a position corresponding to each individual ink cartridge 21.

Because the liquid surface of the ink in the ink chamber 25 goes down toward a bottom surface 25*a* of the ink chamber 25, the ink detection zone 27 is located near the bottom surface 25*a* of the ink chamber 25. The ink run-out sensor 26 is positioned such that the detective portion 26*a* faces the ink detection zone 27 of each ink cartridge 21 as it is set in the carriage 13.

The ink outlet 31 is formed in a lower portion of the ink chamber 25, for taking the ink out of the case body 22 to supply it to the recording head 12. In this example, the ink outlet 31 consists of an ejection tube 32 and a filter 33. The ejection tube 32 is substantially round in section. The filter 33 is inserted from the bottom into the ejection tube 32 and is force-fitted in the ejection tube 32. The ejection tube 29 extends downward from the bottom wall of the case body 22, and is force-fitted into the slot of the carriage 13.

The filter 33 filters the ink as being supplied from the ink cartridge 21 to the recording head 12. The filter 33 is a spongy member that generates a capillary force. The filter 33 absorbs the ink from the ink chamber 25 by its capillary force, and conducts the ink to the ink outlet 31. As the ink cartridge 21 is attached to the carriage 13, the ink supply needle 36 in the slot of the carriage 13 is stuck from the bottom into the filter 33, providing the ink supply path from the ink cartridge 21 through the ink supply needle 36 to the associated nozzle of the recording head 12.

The lid 23 is formed with an air inlet 41 for sending the air into the ink chamber 25 in correspondence with the consumption of the ink. That is, as the ink is supplied to the recording head 12, the air is taken into the ink chamber 25 by an amount corresponding to the consumed amount of the ink.

The lid 23 also has a meander groove 42 formed on its top side. One end 42*a* of the groove 42 is connected to the air inlet 41, and a liquid sink 43 is formed on a path from the end 42*a* to a second end 42*b*. A section of the groove 42 exclusive of the second end 42*a*, i.e. the section between phantom lines in FIG. 2, is covered from the top with a shield 45, so the second end 42*b* alone is exposed to the atmosphere. The groove 42 leads the ink to the liquid sink 43 if the ink leaks out of the ink absorbent chamber 26 through the air inlet 41. So the ink is prevented from leaking out of the ink cartridge 21. The air is introduced from the second end 42*b* into the air inlet 41.

A plurality of ribs 46 are formed on the bottom side of the lid 23 in an area facing to the ink chamber 25. As the lid 23 is attached to the case body 22, the ribs 46 protrude into the ink chamber 25 and come into contact with a top surface of the ink absorbent 28, pressing down the ink absorbent 28 onto the bottom of the ink chamber 25. Thereby, the ink absorbent 28 is fixedly positioned to provide a room between the ink absorbent 28 and the lid 23, preventing the ink absorbent 28 from being displaced to close the air inlet 41.

The ink absorbent 28 is a spongy material having micro holes that generate the capillary force. Concretely, the ink absorbent 28 is made of a porous material, including a foamed material like urethane foam, or a fibrous material like felt. Due to its capillary force, the ink absorbent 28 absorbs and holds the ink, and also generates a negative pressure in the ink chamber 25 relative to the atmosphere. Keeping the pressure in the ink chamber 25 negative to the atmosphere prevents the ink from unexpectedly flowing out of the ink chamber 25 through the ink supply path to the recording head 12 as disposed below the ink chamber 25, and thus from leaking out of the outlet of the nozzle.

The ink absorbent 28 has a width and a depth, which are approximately equal to a width and a depth of the ink chamber 25, so the ink absorbent 28 is contained in the ink chamber 25 with its peripheral surfaces, except the top surface, in contact with inner wall surfaces of the ink chamber 25. The ink absorbent 28 has a cutout 52 in a position that is placed in and around the ink detection zone 27 in the ink chamber 25. Therefore, as the ink absorbent 28 is placed in the ink chamber 25, a compartment 56 without the ink absorbent 28 is provided around the ink detection zone 27 in the ink chamber 25. Although the ink absorbent 28 is formed as a single block in the illustrated embodiment, it is possible to constitute the ink absorbent 28 of a number of blocks. In that case, the compartment 56 is formed by adjusting the respective sizes of the blocks.

As shown in FIG. 3, because of the compartment 56, an interface BS is provided between the compartment 56 and those boundary surfaces of the ink absorbent 28 which border the compartment 56. Since the ink absorbent 28 has the capillary force to absorb the ink, the resistance to the ink flow through the interface BS becomes larger in a direction toward the ink detection zone 27 than in a reversed direction when the ink is consumed so much that its liquid surface LS goes down below the ink detection zone 27.

Figure 3A:
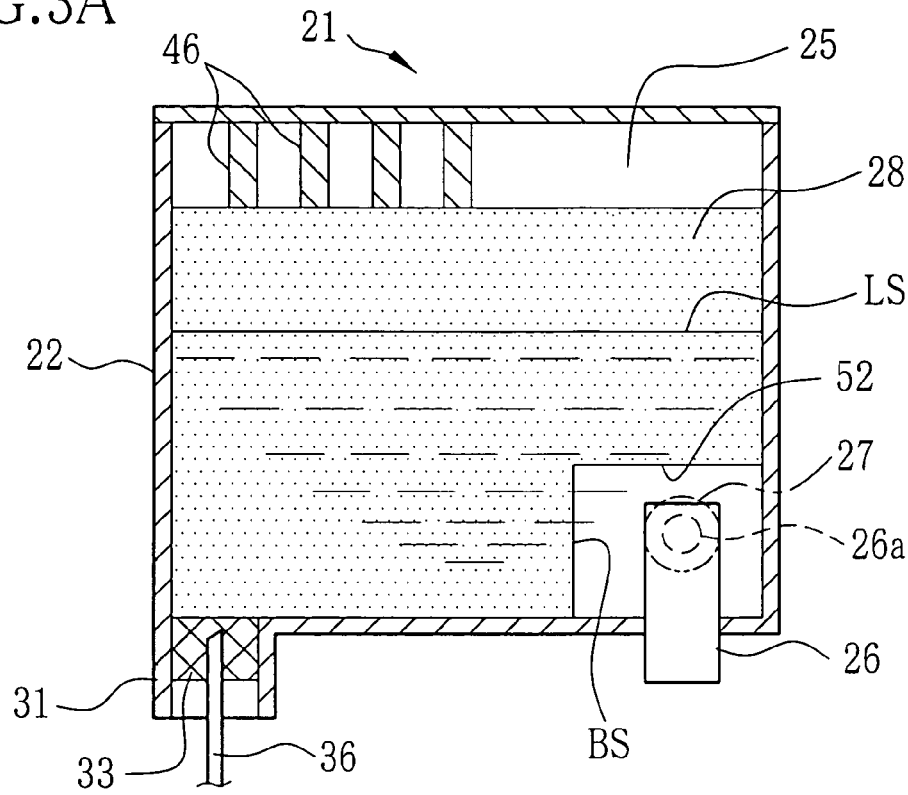
FIGS. 3A and 3B are explanatory sectional views of the ink cartridge of FIG. 2, wherein an ink absorbent has a cutout to form an ink detection room.

As shown in FIG. 3A, the liquid surface LS is above the cutout 52 when the ink starts being consumed, so the compartment 56 and the ink absorbent 28 are filled with the ink. In this condition, the ink absorbed in the ink absorbent 28 is united at the interface BS to the ink in the compartment 56, so there is not much anisotropy in the resistance to the ink flow through the interface BS, and the ink flows smoothly through the interface BS in either direction.

Figure 3B:
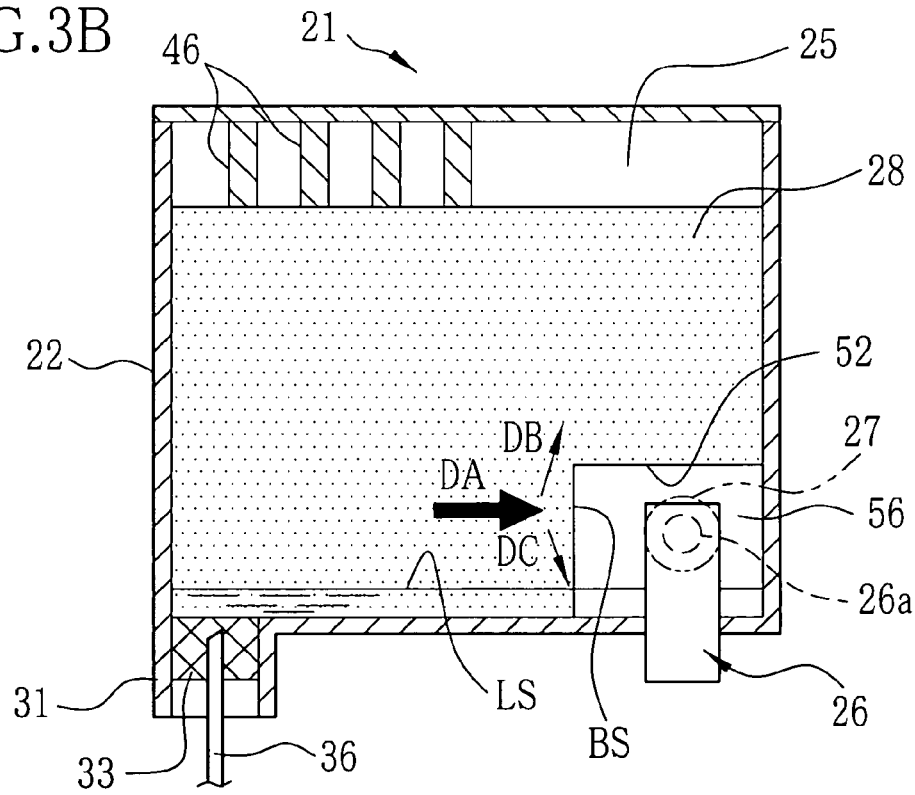

As the ink is consumed, the residual amount of the ink decreases. When the liquid surface LS goes down, as shown in FIG. 3B, the continuity of the ink absorbed in the ink absorbent 28 to the ink in the compartment 56 is broken at the interface BS. As a result, the resistance to flow through the interface BS gets so large that the ink cannot flow through the interface BS even when a force is applied to the ink in a direction toward the ink detection zone 27, as shown by an arrow DA, due to shaking of the ink cartridge 21 or the like. Instead, the ink in the ink absorbent 28 flows in other directions as shown by arrows DB and DC. Accordingly, the ink cannot flow out of the ink absorbent 28 into the compartment 56. Thus, the ink cartridge 21 configured as above prevents the detection error that the ink run-out sensor 26 erroneously detects the ink in the ink detection zone 27, which leads to a misjudgment that a certain amount of ink remains in the ink chamber 25 when the ink actually remains little though.

Since the compartment 56 including the ink detection zone 27 is formed as a vacant space without the ink absorbent 28 in the above embodiment, the capacity of holding the ink in the ink chamber 25 is raised. Since the ink absorbent 28 does not exit in the ink detection zone 27, detection accuracy of the ink run-out sensor 26 is improved. The present embodiment is preferable for use in such an ink-jet recording apparatus wherein the carriage of the recording head does not reciprocate, or reciprocates at a low frequency, so the ink cartridge is less shaken or vibrated. This is because the ink in the vacant space waves more than the ink in the ink absorbent when the ink cartridge is shaken. The more the ink waves, the more the liquid surface bubbles. The bubbles entering the ink detection zone 27 can cause the detection error.

Figure 4:
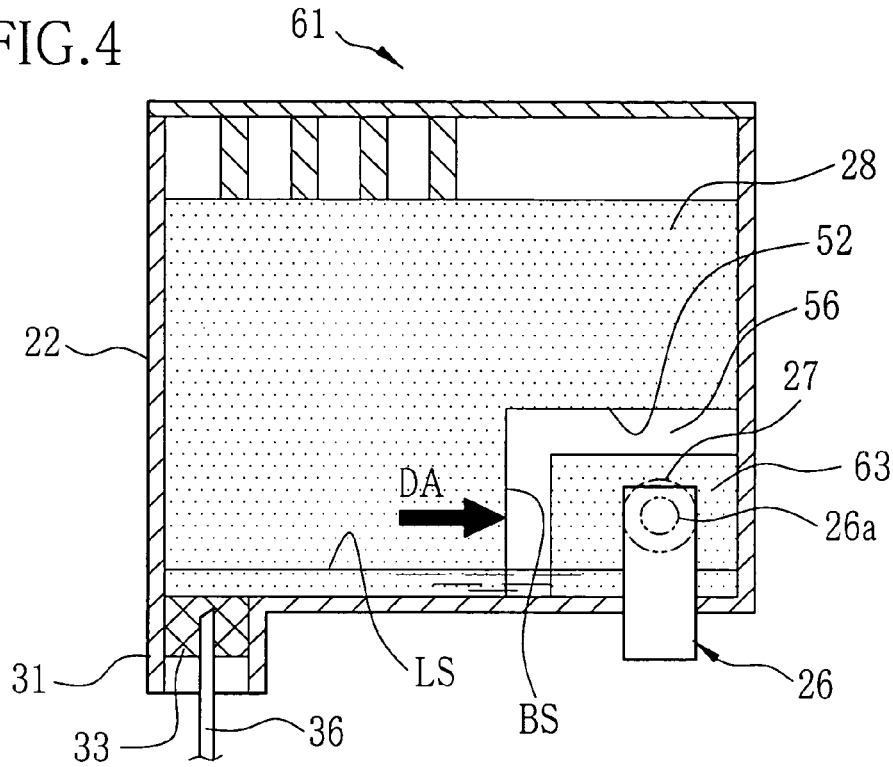
FIG. 4 is an explanatory sectional view of an ink cartridge according to a second embodiment of the invention, wherein a second ink absorbent is disposed in the ink detection room.

As an improvement, FIG. 4 shows an ink cartridge 61 wherein a second ink absorbent 63 is placed in a compartment 56 that is formed by a cutout 52 of a first ink absorbent 28. In the second and following embodiments, equivalent parts are designated by the same reference numerals as in the first embodiment, so the detailed description of these parts may be omitted for brevity sake. The second ink absorbent 63 absorbs and holds the ink in the compartment 56, so the liquid surface of the ink less bubbles when the ink cartridge 61 vibrates, thereby reducing the detection error due to the bubbles. The second ink absorbent 63 may be formed from the same material as the first ink absorbent 28. In that case, the first and second ink absorbents 28 and 63 have the same capillary force. If the second ink absorbent 63 is placed in contact with the first ink absorbent 28, there would be no anisotropy in the resistance to the ink flow through an interface BS. Accordingly, it is desirable to provide a gap between the first and second ink absorbents 28 and 63. The wider the gap between the first and second ink absorbents 28 and 63, the risk of generating the capillary force between them is reduced. So it is preferable to space the first and second ink absorbents 28 and 63 apart from each other as much as possible. Most preferably, the second ink absorbent 63 is so small that it is placed only in an ink detection zone 27 of the ink cartridge 61.

A second ink absorbent placed in the space including the ink detection zone 27 may have different properties from the first ink absorbent 28.

Figure 5:
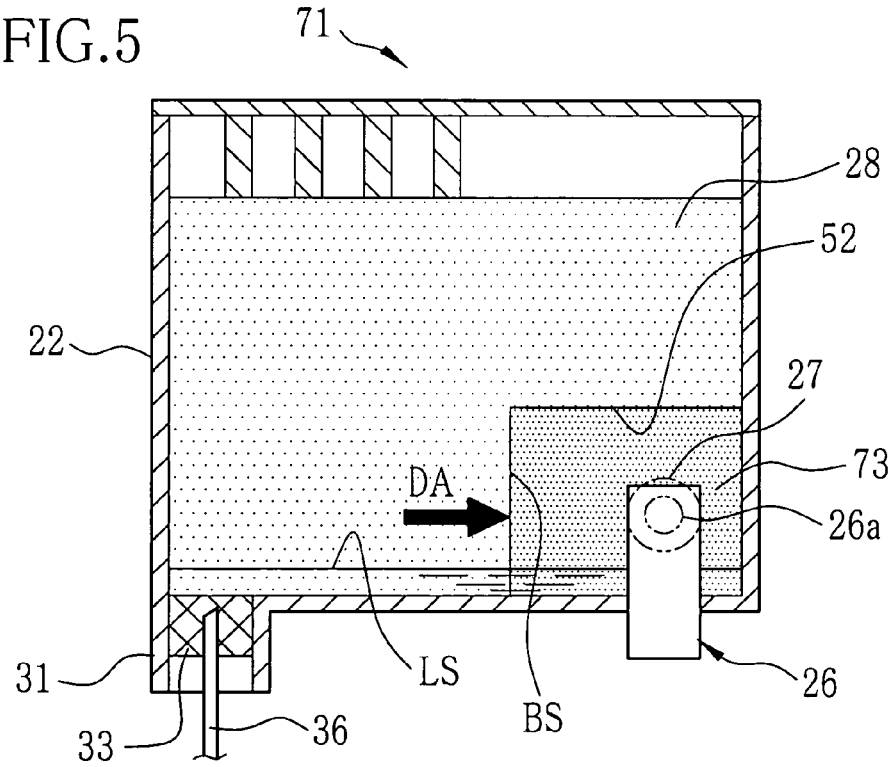
FIG. 5 is an explanatory sectional views of an ink cartridge according to a third embodiment of the invention, using first and second ink absorbents generating different capillary forces.

For example, an ink cartridge 71 shown in FIG. 5 is provided with a second ink absorbent 73 whose capillary force is weaker than that of a first ink absorbent 28. One factor that defines the capillary force of a porous material is the diameter of each pore of the porous material. That is, the larger the diameter of the pore, the smaller the capillary force becomes. So the second ink absorbent 73 is made of a porous material with a larger pore diameter than that of the first ink absorbent 28.

Because of the difference in capillary force between the second ink absorbent 73 and the first ink absorbent 28, the flow resistance through an interface BS varies in the same way as in the above embodiments. Since it is unnecessary to provide a gap between the first and second ink absorbents 28 and 73, the present embodiment is easier to manufacture than the second embodiment shown in FIG. 4. The first and second ink absorbents 28 and 73 are in contact with each other at the interface BS. While the first and second ink absorbents 28 and 73 are filled with the ink, the ink in the first ink absorbent 28 is united to the ink in the second ink absorbent 73 at the interface BS, so there is not much anisotropy in the resistance to the ink flow through the interface BS, and the ink flows smoothly through the interface BS in either directions. As the ink is consumed so much that a liquid surface LS goes down to the interface BS, the continuity of the ink absorbed in the first ink absorbent 28 to the ink absorbed in the second ink absorbent 73 is broken at the interface BS. As a result, the resistance to the ink flow through the interface BS gets so large that it becomes difficult for the ink to flow from the first ink absorbent 28 to the second ink absorbent 73.

Figure 6A:
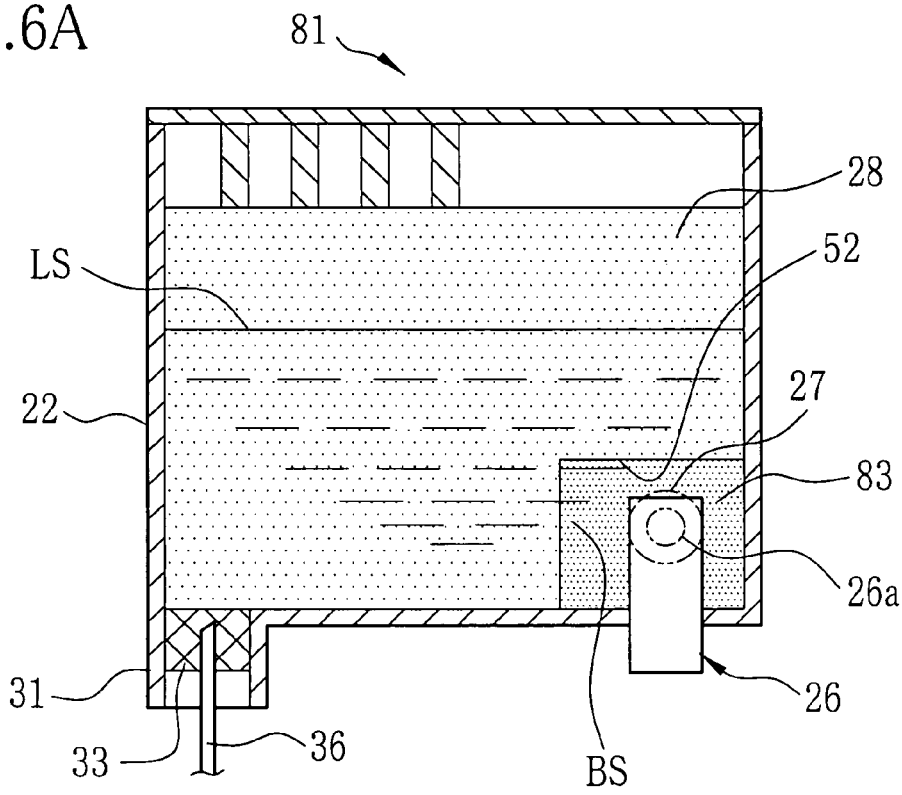
FIGS. 6A and 6B are explanatory sectional views of an ink cartridge according to a fourth embodiment of the invention, using first and second absorbents having different rates of shrinkage.
Figure 6B:
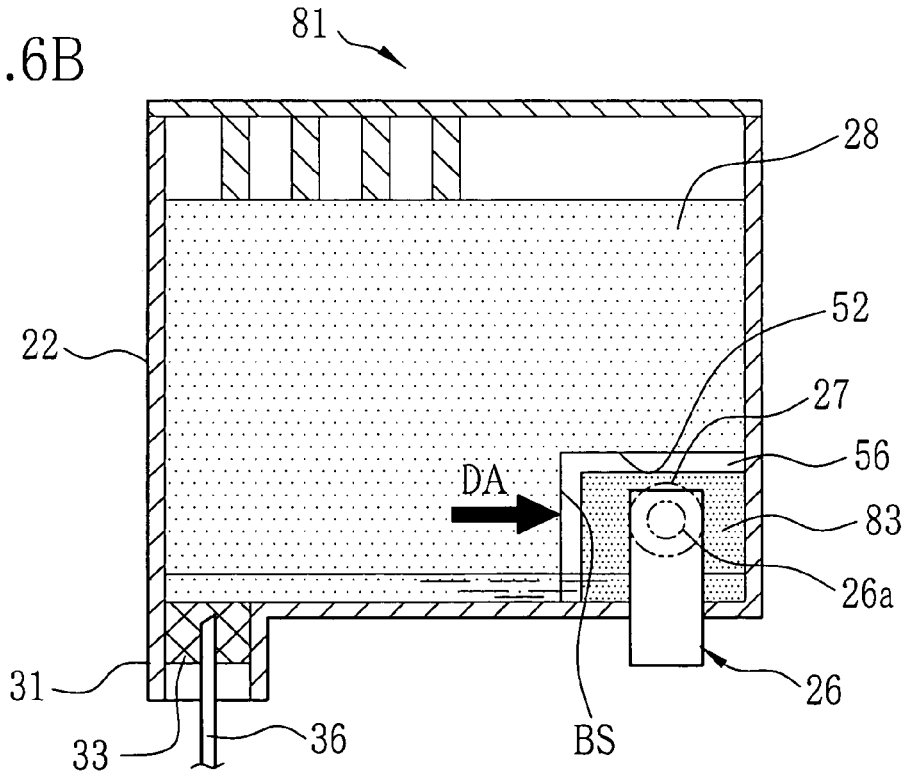

In an ink cartridge 81 shown in FIG. 6, first and second ink absorbents 28 and 83 have such contractibility that their volumes decrease as the ink absorbed therein decreases. The second ink absorbent 83 disposed in a compartment 56 has a higher contraction rate than that of a first ink absorbent 28. Accordingly, as shown in FIG. 6A, while the residual amount of the ink in an ink chamber 25 is so sufficient that the first and second ink absorbents 28 and 83 swell with the ink, the second ink absorbent 83 expands to fill up the compartment 56, and is kept in contact with the first ink absorbent 28. But when the residual amount of the ink is reduced so much that the continuity of the ink is broken, as shown in FIG. 6B, the higher contraction rate of the second ink absorbent 83 gives rise to a gap between the first and second ink absorbents 28 and 83. Then, the anisotropy in the resistance to the ink flow through an interface BS becomes so definite that the ink cannot easily flow into an ink detection zone 27. Thus, the ink cartridge 81 prevents the detection error of an ink run-out sensor 26. Note that the first ink absorbent 28 does not have to have any contractibility in the ink cartridge 81, but the second ink absorbent 83 alone is contractible.

Even though the second ink absorbent 83 is shrinkable, if its position is not fixed, it could happen under some conditions that the gap is not provided between the first and second ink absorbents 28 and 83. Therefore, it is preferable to affix those peripheral surfaces of the second ink absorbent 83 which are in contact with inner wall surfaces of a case body 22, i.e. bottom and right side surfaces of the second ink absorbent 83 in FIG. 6, to these inner wall surfaces of the case body 22, for example, by bonding. Thereby, the contact surfaces of the second ink absorbent 83 are kept in contact with the inner wall surfaces even after the second ink absorbent 83 shrinks, which makes sure of providing the gap between the first and second ink absorbents 28 and 83 by the shrinkage of the second ink absorbent 83.

Insofar as the second ink absorbent 73 or 83 has the different properties, e.g. the different capillary force or the different contraction rate, from the first ink absorbent 28, the second ink absorbent 73 or 83 may be made of the same material as the first ink absorbent 28, for example by changing the pore diameter of the same material. The second ink absorbent 73 or 83 may also be made of a different material having the different properties from the material of the first ink absorbent 28.

As described so far, the ink tank of the present invention provides the interface in a periphery of the ink detection zone, to hinder the ink from flowing into the compartment including the ink detection zone. Thereby, the ink run-out sensor 26 is prevented from erroneously detecting the ink in the ink detection zone 27 when the liquid surface of the ink is actually lower than the ink detection zone 27.

On manufacturing the ink tank of the present invention, it is preferable to inject first the ink into the ink chamber by an amount enough to fill up a predetermined space including the ink detection zone, e.g. the compartment 56 in the illustrated embodiments, with the ink. Thereafter, the ink absorbent or the ink absorbents, as previously soaking the ink, are placed in the ink chamber. This is because, after the ink absorbent is set in the ink chamber, it is hard to fill up the space including the ink detection zone with the ink by injecting the ink, due to the flow resistance at the interface. By filling the space including the ink detection zone with the ink first, the continuity of the ink through the interface is ensured in the first stage of using the ink tank.

Although the present invention has been described with respect to the embodiments wherein the ink run-out sensor is mounted to the ink-jet recording apparatus, an ink run-out sensor may be mounted to an ink cartridge. Then, positioning of the ink run-out sensor to the ink detection zone becomes easier, so the ink detection zone can be made very small. As the size of the ink detection zone gets smaller, the capacity of holding the ink in the ink chamber gets larger.

Although the ink cartridges of the above described embodiments are attached to the recording head with their ink outlets oriented downward, the present invention is applicable to an ink tank whose ink outlet is oriented upward while it is used. In that case, an ink detection zone is located at an upper position of an ink chamber, and a space without a first ink absorbent, and thus an ink detection zone included in that space, is formed in an upper area of the ink chamber.

Although the ink tank of the present invention has been described with respect to the ink cartridge that is formed separately from the recording head and removably attachable to the recording head, the present invention is applicable to an ink cartridge wherein an ink tank is formed integrally with a recording head. The present invention is also applicable to an ink tank that is fixedly mounted to an ink-jet recording apparatus.

Thus the present invention is not to be limited to the above-described embodiments, but various modifications will be possible without departing from the scope of claims as appended hereto.

What is claimed is:

1. An ink tank containing ink in an ink chamber, for supplying the ink to an ink-jet recording head, said ink tank comprising:

an ink detection zone defined in said ink chamber, for an ink run-out sensor to detect as to whether the ink exits or not;

an interface provided around said ink detection zone, said interface enhancing resistance to the ink flow in a direction toward said ink detection zone more than in a reversed direction when the ink is consumed so much that its liquid surface goes out of said ink detection zone, a first ink absorbent placed in said ink chamber, said first ink absorbent having a capillary force to absorb and hold the ink in said first ink absorbent, and generate a negative pressure in said ink chamber, and said first ink absorbent including a cutout defining a compartment that includes said ink detection zone, and said cutout providing said interface between said ink detection zone and boundary surfaces of said first ink absorbent which border said cutout.

2. An ink tank as claimed in claim 1, wherein said first ink absorbent consists of at least a block.

3. An ink tank as claimed in claim 1, further comprising a second ink absorbent placed in said compartment.

4. An ink tank as claimed in claim 3, wherein said second ink absorbent is spaced apart from said first ink absorbent.

5. An ink tank as claimed in claim 3, wherein said first and second ink absorbents are made of the same material.

6. An ink tank as claimed in claim 3, wherein said first and second ink absorbents are made of different materials from each other.

7. An ink tank as claimed in claim 3, wherein said second ink absorbent has a weaker capillary force than said first ink absorbent.

8. An ink tank as claimed in claim 7, wherein said second ink absorbent has pores whose diameter is larger than that of pores of said first ink absorbent.

9. An ink tank as claimed in claim 3, wherein said second ink absorbent has such contractibility that its volume decreases as the ink absorbed in said second ink absorbent decreases.

10. An ink tank as claimed in claim 9, wherein both of said first and second ink absorbents are contractible, and said second ink absorbent contracts at a higher contraction rate than said first ink absorbent.

11. An ink tank as claimed in claim 9, wherein said first and second ink absorbents are fixed to predetermined positions in said ink chamber.

12. An ink tank as claimed in claim 1, wherein said ink tank is formed as a cartridge that is removably attachable to said ink-jet recording head.

* * * * *